United States Patent [19]

Thrap-Olsen

[11] Patent Number: 4,611,544

[45] Date of Patent: Sep. 16, 1986

[54] BURNER FOR PARTICULATE FUEL

[76] Inventor: Olav Thrap-Olsen, Älgvägen 13, Lidingö , Sweden, S-181 43

[21] Appl. No.: 670,829

[22] Filed: Nov. 13, 1984

[30] Foreign Application Priority Data

Nov. 16, 1983 [SE] Sweden ..... 8306289

[51] Int. Cl.[4] ..... F23B 7/00

[52] U.S. Cl. ..... 110/341; 110/226; 110/246; 110/347

[58] Field of Search ..... 110/246, 346, 341, 347, 110/226, 185

[56] References Cited

U.S. PATENT DOCUMENTS

| | | | |
|---|---|---|---|
| 3,412,697 | 11/1968 | Matteini . | |
| 3,668,505 | 6/1972 | Dalton et al. . | |
| 3,727,565 | 4/1973 | Schoppe et al. . | |
| 3,783,802 | 1/1974 | Schrage . | |
| 3,785,306 | 1/1974 | Jaget | 110/246 X |
| 3,842,762 | 10/1974 | Sargent et al. | 110/246 |
| 4,395,958 | 8/1983 | Caffyn et al. | 110/246 |
| 4,408,547 | 10/1983 | Autere | 110/246 X |

FOREIGN PATENT DOCUMENTS

| | | |
|---|---|---|
| C62630 | 5/1892 | Fed. Rep. of Germany . |
| C498070 | 5/1930 | Fed. Rep. of Germany . |
| 583317 | 9/1933 | Fed. Rep. of Germany . |
| 1227180 | 10/1966 | Fed. Rep. of Germany . |
| 1033663 | 4/1953 | France . |
| 1434880 | 5/1976 | United Kingdom . |
| 1489331 | 10/1977 | United Kingdom . |
| 1521088 | 8/1978 | United Kingdom . |
| 2079910 | 1/1982 | United Kingdom . |

OTHER PUBLICATIONS

WIPO Publication 82/00187, Jan. 21, 1982.

*Primary Examiner*—Edward G. Favors

[57] ABSTRACT

The present invention relates to a method for combusting solid fuel in the form of particles, preferably fuel pellets, whereby the fuel is combusted in a rotating combustion chamber (1) whereby the speed of the rotating the chamber is varied so that the fuel periodically releases from the chamber wall and skids along said wall.

7 Claims, 1 Drawing Figure

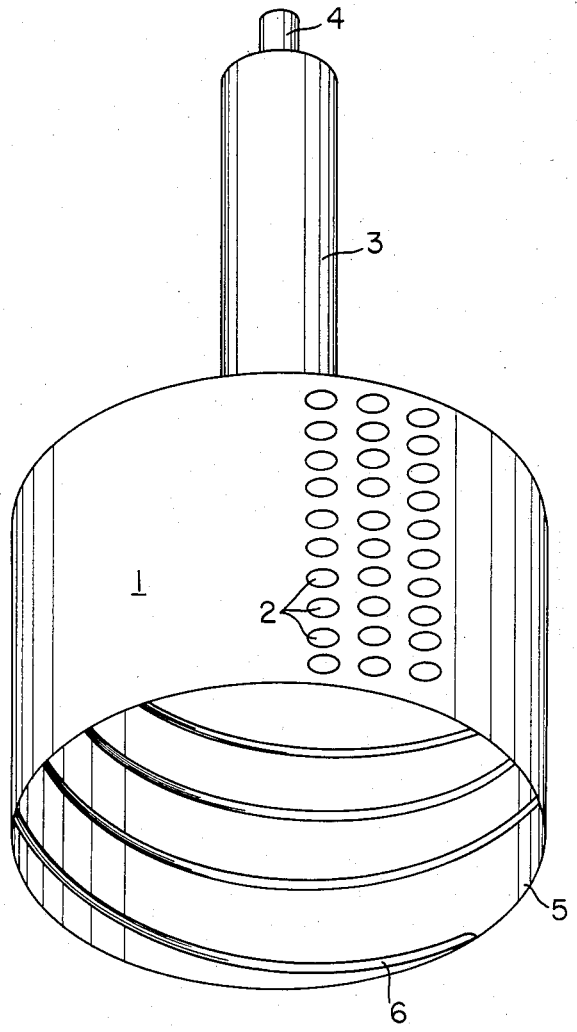
4
3
1
2
5
6

BURNER FOR PARTICULATE FUEL

DESCRIPTION

1. Technical Field

The present invention relates to a method for burning, and a burner for solid fuels in the form of particles, preferably fuel pellets, which burner has a rotably arranged burning chamber, preferably provided with a perforated cylindrical wall, connected to a rotably arranged tubular shaft.

The object of the present invention is to obtain an improved method of burning solid fuels during rotation, and a burner hereto, in order to reduce or even eliminate variations in the thickness of the burning hearth bed, and to minimize the need for stand-still for cleansing the burner.

2. Background of the Invention

It is known in the art to feed a solid fuel in the form of particles, and even particles having a regular shape in the form of extruded pellets to a burner, which is rotating around its longitudinal axis, whereby the burner chamber comprises a cylindrical perforated housing or a ball-shaped perforated chamber into which the fuel is fed via a tubular shaft or a part thereof. The shaft is arranged to rotate around its longitudinal axis as mentioned above, whereby the solid fuel is pressed against the wall by means of the centrifugal force and air is allowed to enter the fuel to provide oxygen for burning, either for gas generation and/or for heat generation. Ashes are removed via said perforations as well.

However, it has turned out that the hearth bed will vary considerably in thichness with tendencies to build up, i.e. to increase in thichness where already too thick. This means that the burning of the pellets, or fuel in particle form, will become incomplete due to difficulties for the incoming air to enter the unburned parts. Further, the ashes will have difficulties in passing out, which means that the ashes will embed the particles and isolate them and in this way not allow air thereto.

It has also turned out that the perforated wall will become more or less unperforated due to the fact that the particles, more or less burned out, will primarily attach to the edges of the perforations, or openings, and coke there, whereby the perforations become smaller and smaller, allowing lesser and lesser amounts of air into the hearth. This cause of events is fairly rapid and the burner has to be cleansed even so often, every month or every second month. This means bad operation economy.

DISCLOSURE OF THE PRESENT INVENTION

It has now surprisingly been found possible to eliminate these drawbacks by means of the present invention, which is characterized in that the rotation of the rotating burner chamber is varied in such a way as to allow the hearth bed to periodically release from the rotating wall and skid along the wall.

Further characteristics are evident from the accompanying claims.

By means of the invention an even thickness of the hearth bed of solid fuel is obtained; a continuous removal of ashes is obtained; and the cleansing can be reduced to once or twice a year. The even hearth bed provides for a complete burning out of the fuel, which further improves the energy yield.

The present invention will be described more in detail in the following with reference to the attached drawing wherein the sole FIGURE shows a perspective view of a burner chamber with its shaft.

1 denotes a cylindrical burner chamber wall having perforations 2 therein. The burner chamber 1 has an open front end 5 and a closed rear end. The burner chamber is attached to a rotably arranged tubular shaft 3 having a concentrically arranged nonrotably feeding-tube 4 therein. The transmission and engine which drives this shaft 3 is not shown. The inside of the burner chamber wall 1 has a helical strip 6 attached thereto.

A solid fuel such as coal in particle form, or compressed, extruded peat pellets, or other fuels in particle form is fed through the non-rotably tube 4 and is burned in the chamber upon rotation thereof in such a way that the fuel is pressed against the wall. Every 90 seconds, or more often, or more seldom, if so desired, the power to the engine rotating the shaft is either reduced or completely switched off inducing a reduction in revolution speed, whereby the fuel releases from the wall and starts to skid along this wall. Due to the presence of the strip 6 the fuel bed will become transported in either direction, preferably towards the opening 5, whereby it is transported out of the the chamber with such a speed that it has become completely bunrt out when passing the opening. While skidding the fuel will remove any particles tending to attach to the perforations, and/or the wall, and will keep the wall substantially free from attaching fuel. When the fuel has skid to some extent and tends to fall over, the revolution speed is increased to such an extent that the fuel is pressed against the wall again. The speed of the burner chamber is depending on the diameter and the fuel density, and can be easily determined.

The reduction in rotation can be obtained in different ways as well understood by the one skilled in the art of transmissions.

Under certain circumstances depending on the fuel used it may be advantageous not to use a perforated chamber wall 1 but have a closed one. Hereby all ashes produced are transported out through the front opening. In that case the air (oxygen) needed is introduced via the shaft 3, and the tube 4, and/or via a lance (not shown) arranged at the open end of the chamber. This lance can very well be introduced through said tube 4, and then bent at an angle of 180° at the opening to blow air into the chamber.

I claim:

1. A method for combusting solid fuel in particulate form wherein fuel and air are supplied to a combustion chamber within which combustion occurs in a bed, wherein:

(i) said combustion chamber has a substantially cylindrical wall and is rotated at a rate to generate sufficient centrifugal force to maintain said bed against said wall and (ii) the rotation of said combustion chamber is interrupted at periodic intervals such that the rotational speed will slow at least sufficiently that the bed will release from said wall during said intervals and skid along it.

2. A method according to claim 1 wherein said fuel is in the form of fuel pellets.

3. A method according to claim 1 wherein said cylindrical wall includes a plurality of openings.

4. A method according to claim 1, characterized in that the skidding is arranged to take place along a helical path.

5. An apparatus for combusting solid fuel in particulate form having a combustion chamber within which combustion occurs in a bed and means for supplying particulate fuel and air thereto wherein (i) said combustion chamber has a substantially cylindrical wall, and there are (ii) means operably connected to said combustion chamber for rotating said chamber at a rate which generates sufficient centrifugal force to maintain said bed against said wall, and (iii) means for interrupting said rotation at periodic intervals whereby during said intervals said rotation slows sufficiently that said bed will release from said wall during said interval and skid along it.

6. An apparatus according to claim 5 wherein said combustion chamber has a plurality of openings in its wall.

7. A burner according to claim 5, characterized in that the combustion chamber wall (1) at its inside is provided with a helically arranged strip (6), allowing any skidding fuel to be transported within the combustion chamber.

* * * * *